United States Patent [19]

Cheung

[11] 4,345,925

[45] Aug. 24, 1982

[54] PROCESS FOR THE PRODUCTION OF HIGH PRESSURE OXYGEN GAS

[75] Inventor: Harry Cheung, Kenmore, N.Y.

[73] Assignee: Union Carbide Corporation, Danbury, Conn.

[21] Appl. No.: 210,733

[22] Filed: Nov. 26, 1980

[51] Int. Cl.[3] ..... F25J 3/04

[52] U.S. Cl. ..... 62/13; 62/29; 62/40; 62/41

[58] Field of Search ..... 62/40, 41, 13, 15, 29, 62/22, 38

[56] References Cited

U.S. PATENT DOCUMENTS

| | | | |
|---|---|---|---|
| 2,784,572 | 3/1957 | Wucherer et al. | 62/41 |
| 3,062,016 | 11/1962 | Dennis et al. | 62/22 |
| 3,222,878 | 12/1965 | Becker | 62/41 |

OTHER PUBLICATIONS

Die Gewinning von Hockdruck-Sauerstof, Springmann, Linde Berichte aus Technik und Wissenschaft, vol. 46, pp. 3–7, Dec. 1979.

*Primary Examiner*—Norman Yudkoff

*Attorney, Agent, or Firm*—Stanley Ktorides; Lawrence G. Kastriner

[57] ABSTRACT

Oxygen gas is produced at greater than atmospheric pressure by separating air into oxygen-rich and nitrogen-rich fractions in a distillation column, removing the oxygen as liquid and pumping it to the desired pressure and subsequently vaporizing the pumped liquid oxygen by means of energy absorbed from a recirculation argon containing fluid.

7 Claims, 6 Drawing Figures

PROCESS FOR THE PRODUCTION OF HIGH PRESSURE OXYGEN GAS

BACKGROUND OF THE INVENTION

This invention relates to an improved air separation process wherein oxygen is produced at greater than atmospheric pressure.

Users of oxygen gas often require that the oxygen be delivered at a pressure greater than atmospheric pressure. In the past, this requirement has been met by compressing the oxygen gas to the desired pressure after the oxygen has been normally produced at low pressure in a cryogenic air separation plant. However, this method has significant disadvantages due to the explosive nature of highly compressed oxygen. Thus oxygen gas compression requires special care including special materials of construction, special lubrication techniques, and special compressor design to minimize possible metal to metal contact. It is common practice to place the oxygen gas compressor behind a concrete barrier to shield workmen and equipment should an explosion occur in the compressor. The hazards of oxygen gas compression increase as the pressure to which the oxygen must be compressed is increased.

In order to avoid the above mentioned difficulties, another method of producing oxygen at pressure has been devised. This method involves taking oxygen off the air separation column as a liquid, pumping the liquid to the desired pressure and then vaporizing the oxygen at that pressure. U.S. Pat. No. 2,784,372 to Wucherer et al describes such a method wherein argon is employed to vaporize the liquid oxygen.

Liquid oxygen pumping generally has not met with great commercial success to date primarily due to inefficiencies relates to distillation column performance. Because the oxygen is taken off as liquid, thermodynamic requirements dictate that liquid, sufficient to maintain an energy balance, i.e., equivalent in refrigeration value, be supplied to the column. In past practice, this liquid is supplied by condensing a sufficient portion of the incoming air stream to serve as the liquid makeup. Unfortunately, this results in downgraded column performance as that portion of the air stream which is liquefied bypasses some of the column separation.

Another method of producing oxygen gas at pressure involves recirculating nitrogen fluid to vaporize the liquid oxygen. This method is disadvantageous because nitrogen does not match the thermodynamic properties of oxygen resulting in process inefficiencies.

Oxygen at high pressure is increasing in demand especially as coal conversion and other synthetic fuel processes are increasingly employed. These synthetic fuel processes require oxygen gas at a pressure considerably above atmospheric. This increased pressure requirement makes oxygen gas compression a less desirable option. Therefore, a method by which oxygen gas can be produced at greater than atmospheric pressure and which overcomes the heretofore unavoidable degradation of column performance would be highly desirable.

OBJECTS

Accordingly, it is an object of this invention to provide an improved air separation process which produces oxygen gas at greater than atmospheric pressure.

It is another object of this invention to provide an improved air separation process for producing oxygen gas at pressure which avoids the above mentioned problems.

It is a further object of this invention to provide an air separation process for producing oxygen gas at pressure wherein no portion of the air feed stream need be diverted for liquid makeup to achieve distillation column energy balance.

Other objects of this invention will become readily apparent to those skilled in the art upon reading of the disclosure.

SUMMARY OF THE INVENTION

This invention is a process for the production of oxygen gas at pressure comprising the steps of:

(a) introducing cleaned, cooled air into a distillation column;

(b) separating said air into oxygen-rich and nitrogen-rich fractions in said column;

(c) removing from said column at least a portion of said oxygen-rich fraction as liquid;

(d) pumping said liquid oxygen-rich portion to the desired pressure;

(e) vaporizing said liquid oxygen-rich portion to oxygen gas at said desired pressure by indirect heat exchange with a recirculating argon containing fluid comprising from 50 to 100 mole percent argon and from 0 to 50 mole percent oxygen;

(f) recovering said oxygen gas at said desired pressure;

(g) removing from said column at least a portion of a nitrogen-rich fraction as gas;

(h) condensing said gaseous nitrogen-rich portion by indirect heat exchange with said recirculating argon containing fluid; and (i) returning said condensed nitrogen-rich portion back to said column, wherein said condensed nitrogen-rich portion is returned to said column in amount sufficient to make up the nitrogen liquid reflux associated with said removed liquid oxygen-rich portion.

In another embodiment of the process of this invention the argon containing fluid is additionally employed to provide plant refrigeration.

In another embodiment of the process of this invention the argon containing fluid is additionally employed to provide plant refrigeration and cold end reversing heat exchanger temperature control.

By cleaned, cooled air, it is meant air which has been substantially cleaned of atmospheric contaminants such as water vapor, carbon dioxide and hydrocarbons and which has been cooled to close to the saturation temperature.

By oxygen-rich and nitrogen-rich, it is meant a fluid containing 50 mole percent or more of oxygen or nitrogen respectively.

By pumping, it is meant a process which increases the energy of a fluid; one such process is compression.

By indirect heat exchange, it is meant that the respective streams involved in the heat exchange process are brought into heat exchange relationship without any physical contacting or intermixing of such streams with one another. Indirect heat exchange may thus for example be effected by passage of the heat exchange streams through a heat exchanger wherein the streams are in distinct passages and remain physically segregated from one another in transit through the exchanger.

The term "product", as used herein refers to a fluid stream which is discharged from a distillation column in the process system without further distillation separation therein.

DESCRIPTION OF THE INVENTION

One version of the process of this invention in its broadest embodiment is described with reference to FIG. 1. The feed air stream 14 is a pressurized air stream that is obtained by filtering, compressing and water cooling ambient atmospheric air. The pressure energy associated with feed stream 14 is utilized for the separation energy.

The air stream should be cleaned of carbon dioxide and water vapor. One way of accomplishing this is by passing the air stream through a molecular sieve adsorbent bed arrangement. Another way of cleaning the air stream of carbon dioxide and water vapor is to pass the air stream through reversing heat exchangers to cool the air stream so that the carbon dioxide and water vapor condense and freeze on the heat exchanger surfaces. Periodically, the air and nitrogen streams are reversed and the nitrogen vapor from the column is passed through the heat exchangers to clean out the deposited carbon dioxide and water contaminants. The reversing heat exchanger option is illustrated in FIG. 1.

Figure 1:
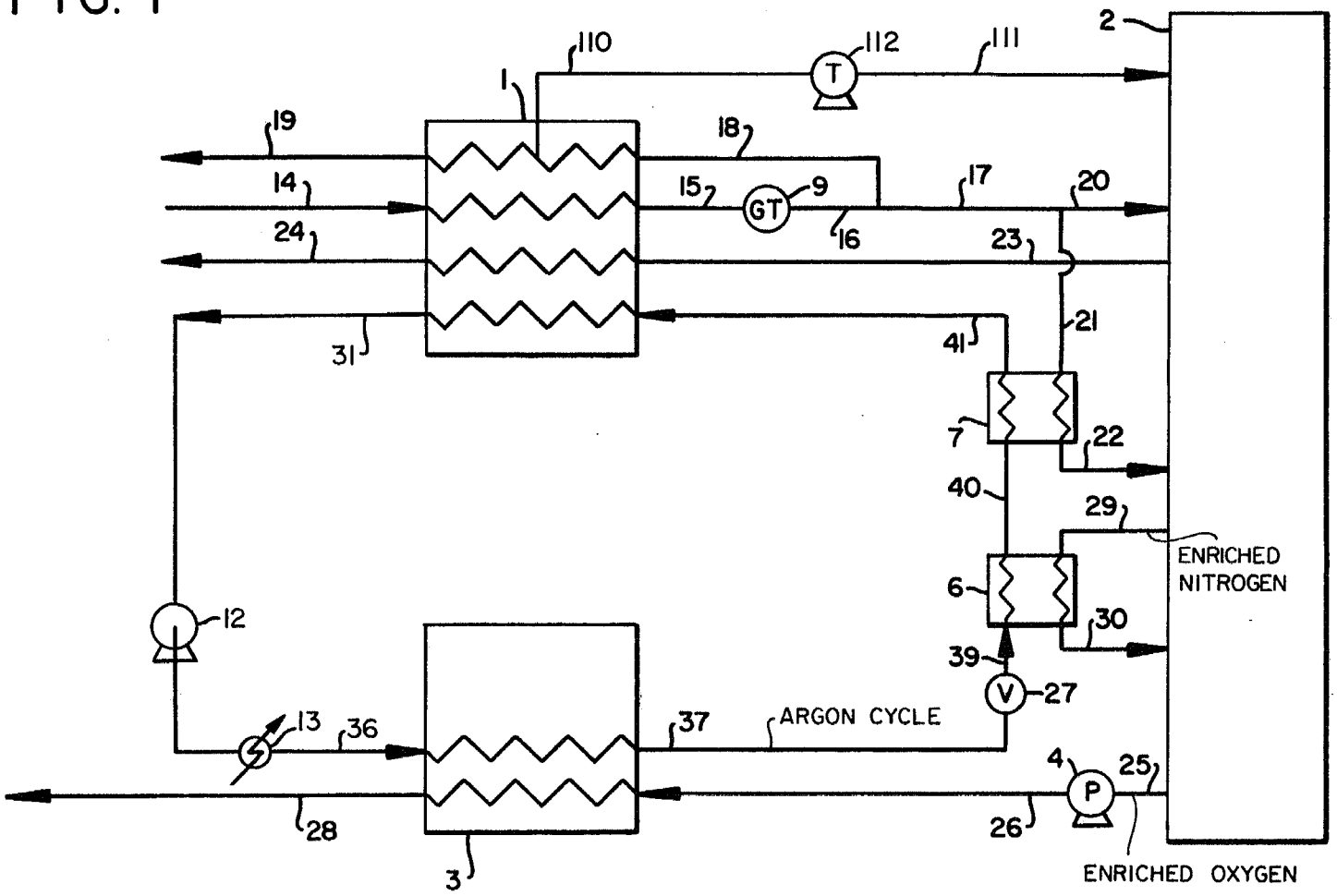
FIG. 1 is a schematic flow diagram representing the process of this invention, illustrating the argon containing fluid vaporizing the pumped liquid oxygen at heat exchanger 3 and condensing the nitrogen vapor at heat exchanger 6.

Continuing now with the description of the process of this invention with reference to FIG. 1, the feed air stream enters reversing heat exchanger unit 1 at ambient temperature condition and is cooled in that heat exchanger to close to saturation temperature at the exit 15 of that heat exchanger unit. As explained above, carbon dioxide and water vapor are plated out as the feed air is cooled. A suitable adsorbent trap 9 containing materials such as silica gel is used for secondary contaminant removal purposes. This gel trap removes any contaminant that may not have been removed in the reversing heat exchanger unit and also serves to filter out any contaminant solids that may be carried over by the air stream. The completely cooled and cleaned air stream 16 downstream of the cold end gel trap is then subdivided for several purposes. One fraction 18 is diverted back to the reversing heat exchanger unit. A small amount is warmed to ambient condition 19 for use as instrument air supply for plant control purposes. Another amount 110 is withdrawn from the heat exchanger for cold end temperature control purposes, work expanded 112 to develop plant refrigeration and added to the column as low pressure air feed 111. The remaining stream 17 flows to distillation column section 2. One minor portion 21 is used to warm a portion of the recirculating heat pump fluid and is thereby condensed 22 and introduced to the distillation column section. The remainder of the air stream 20 is introduced to the distillation column section.

Any suitable distillation column for separating air into oxygen-rich and nitrogen-rich fractions may be employed with the process of this invention.

"Distillation" as used herein refers to separation of fluid mixtures in a distillation column, i.e., a contacting column wherein liquid and vapor phases are countercurrently and adiabatically contacted to effect separation of a fluid mixture, as for example by contacting of the vapor and liquid phases on a series of vertically spaced-apart trays or plates mounted within the column, or alternatively on packing elements with which the column is filled. For an expanded discussion of the foregoing, see the Chemical Engineers' Handbook, Fifth Edition, edited by R. H. Perry and C. H. Chilton, McGraw-Hill Book Company, New York, Section 13, "Distillation", B. D. Smith et al, page 13-3, *The Continuous Distillation Process.*

A common system for separating air employs a higher pressure distillation column having its upper end in heat exchange relation with the lower end of a lower pressure distillation column. Cold compressed air is separated into oxygen-rich and nitrogen-rich liquids in the higher-pressure column and these liquids are transferred to the lower-pressure column for separation into nitrogen- and oxygen-rich fractions. Examples of this double-distillation column system appear in Ruheman's "The Separation of Gases", Oxford University Press, 1945.

Continuing now with the description of FIG. 1, within the column section 2, the feed air is separated into product oxygen liquid 25 and waste nitrogen vapor 23 as will be explained later. The waste nitrogen vapor 23 passes to the reversing heat exchanger section whereby it exchanges its refrigeration with the cooling air and is removed as ambient temperature low pressure waste gas 24. The product liquid oxygen 25 is pressurized by pump unit 4 to the desired product pressure. The necessary pressurization by pump 4 can also supply any pressure drop associated with the subsequent warming of that product liquid. Following pumping of the product liquid, the pressurized liquid oxygen 26 is introduced to high pressure heat exchanger unit 3. Within that unit, the product liquid oxygen is vaporized and warmed to ambient temperature pressurized condition 28. At the warm end of heat exchanger 3, the product oxygen 28 is at ambient temperature and at the supply pressure desired for the application.

The remaining process arrangement associated with the system is directed towards fluid circuit and heat exchange associated with the heat pump loop utilizing the argon containing recirculating fluid. Within the high pressure heat exchanger 3, the product oxygen is vaporized by cooling of high pressure ambient temperature recirculating fluid medium 36. This fluid is cooled and condensed versus the vaporizing oxygen and removed as condensed liquid 37 from the heat exchange step. That liquid is then expanded in valve 27 so that it is a low pressure liquid 39 suitable for heat exchange with nitrogen vapor obtained from the high pressure column of the column section. Within side condenser 6, the low pressure liquid 39 is vaporized to a low pressure gas 40 versus condensing nitrogen fluid 29. Following condensation of the nitrogen in the side concondenser, the liquid nitrogen 30 is re-introduced to the high pressure column. Basically, this heat exchange has the function of replacing reflux liquid within the high pressure column that would otherwise be formed by vaporizing liquid oxygen within the column section. Following vaporization in the side condenser 6, the low pressure heat pump fluid 40 is superheated in unit 7 versus condensing air slip stream 21. The superheated fluid 41 is introduced to reversing heat exchanger unit 1. Within reversing heat exchanger unit 1, stream 41 is warmed and exits the reversing heat exchanger as stream 31. The stream is compressed in compressor unit 12, water cooled in unit 13 to remove the heat of compression, and then becomes the heat pump portion 36.

Figure 5:
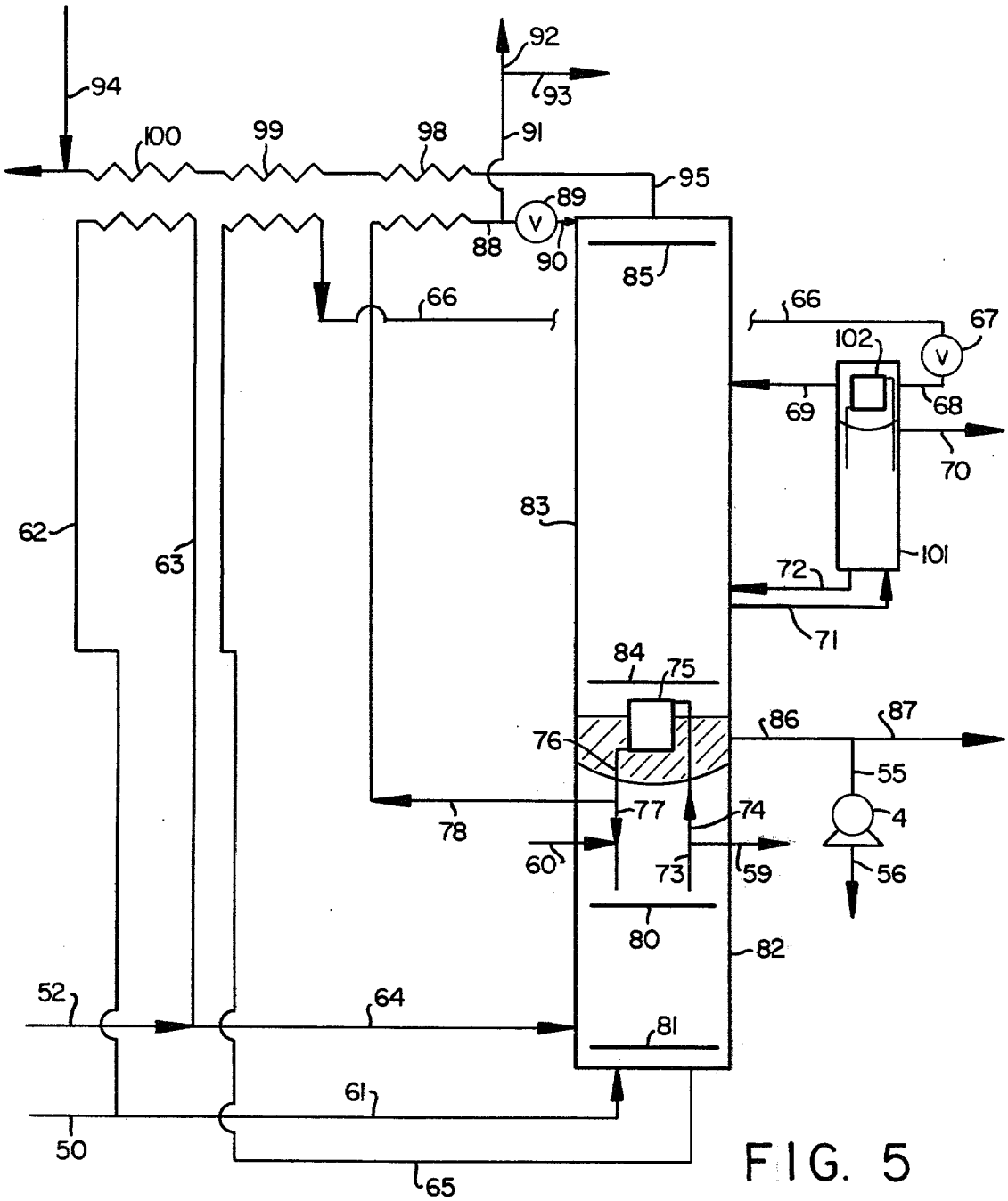
FIG. 5 shows a double column distillation column.

The details of the column 2 section used with the process of this invention are illustrated in FIG. 5, which illustrates the double column arrangement which is generally employed in cryogenic air separation and is preferably used with the process of this invention. The column arrangement shown in FIG. 5 includes additional production compared to that illustrated in the FIG. 1 embodiment. The FIG. 1 illustrated arrangement is preferred for the production of product liquid oxygen only which is subsequently vaporized to produce high pressure ambient gas whereas the FIG. 5 illustration includes additional products including crude argon and some liquid oxygen at low pressure and liquid nitrogen at low pressure. It is understood that the particular product production associated with the double column can have the usual flexibility of the double column arrangement and can include the base liquid oxygen which is pumped to produce a high pressure gas but is not limited to the oxygen product and could also include nitrogen production, argon production and some low pressure liquid production as desired for the particular application.

As noted, the column section illustrated in FIG. 5 is a standard double column arrangement. For clarity, the operation of the system will be described for the particular FIG. 5 arrangement. The majority of the air feed 50 enters the column section as a clean and cold but pressurized vapor stream. A minor fraction 62 is used to superheat waste nitrogen in exchanger 100 and the condensed liquid air from that unit 63 is then combined with the liquid air available from other superheaters 52. The combined liquid air stream 64 is introduced towards the bottom of high pressure column 82. The remaining feed air stream gas 61 is introduced at the bottom of column 82. Within that column, the tray section represented by bottom plate 81 and top plate 80, serves to preseparate the air into several intermediate streams. At the top of the column, the rising gas stream 73 is a high nitrogen content stream which is the source of the nitrogen stream 59 that is condensed versus the heat pump fluid. The remaining portion of that stream 74 is condensed in condenser unit 75 versus boiling oxygen-rich stream in the low pressure column 83. The condensed nitrogen-rich stream 76 is then split for several purposes. One portion 77 is returned to the column as liquid reflux and can be combined with returning condensed liquid nitrogen stream 60. The combined liquid is introduced to the first tray 80 and then proceeds through the column and the liquid is enriched in oxygen content. The bottom liquid stream 65 is an oxygen-rich liquid that is removed from that column. Another portion of the condensed nitrogen stream 78 is first subcooled in heat exchanger 98. The subcooled pressurized liquid nitrogen stream 88 is then split further. One portion is expanded in valve 89 and introduced as liquid reflux 90 to the top of low pressure column 83. Another portion remaining at pressure 91 is removed from the column section and is further divided into two portions. One portion 93 can be removed as liquid product from the system. Another portion 92 is removed as liquid and used in argon purification columns associated with upgrading the crude argon stream 70 to ultrahigh purity typically required for the merchant market. That liquid portion 92 is normally vaporized in that purification section and is typically returned as cold gas stream 94 which is then added to the waste nitrogen stream for additional recovery of its refrigeration. The kettle liquid 65 which is an oxygen-rich fraction removed from the bottom of high pressure column 82 is subcooled in exchanger 99 and then proceeds as subcooled liquid 66 to condenser unit 102 associated with the argon column 101. This column takes an intermediate feed from the low pressure column 83 between bottom tray 84 and top tray 85 and processes that feed to produce crude argon. The slip stream drawn from the low pressure column 71 is processed in the tray section associated with 101 to produce the crude argon fraction 70 and the returning liquid fraction 72 which is re-introduced to the low pressure column. The column itself is driven by the refrigeration associated with expanding the kettle liquid valve 67 so that stream 68 is a combined low pressure gas and liquid stream. Within condenser 102 that expanded liquid provides refrigeration for producing a reflux for the argon column. Depending on column conditions, normally only a portion of the liquid is vaporized and a combined gas and liquid, kettle liquid based, stream 69 is introduced to the low pressure column. The multisection column represented by bottom tray 84 and top tray 85 proceeds to separate its feed streams into a waste nitrogen stream 95 and an oxygen liquid stream 86. The oxygen liquid stream 86 can be the source of a small low pressure liquid oxygen product 87. Primarily, it is the source of stream 55 which is then pressurized in pump 4 and is the high pressure liquid oxygen product 56 which when vaporized becomes the high pressure gas product. The waste nitrogen stream 95 proceeds through the staged superheating exchangers previously outlined and then continues to the reversing heat exchanger section.

As described above, the oxygen-rich fraction is removed as liquid. The liquid is then pumped to the desired pressure. The desired pressure is greater than atmospheric pressure and is that pressure which one wishes to have the oxygen gas delivered at, plus a suitable increment to account for pressure drop.

The nitrogen gas is condensed and returned to the column in an amount to make up the amount of nitrogen liquid reflux which was not condensed in the column because the oxygen was removed from the column as liquid.

Any amount of oxygen may be removed as the liquid oxygen-rich portion. However, it is preferred that 50 percent or more of the available oxygen product be removed as the liquid oxygen-rich fraction.

Figure 2:
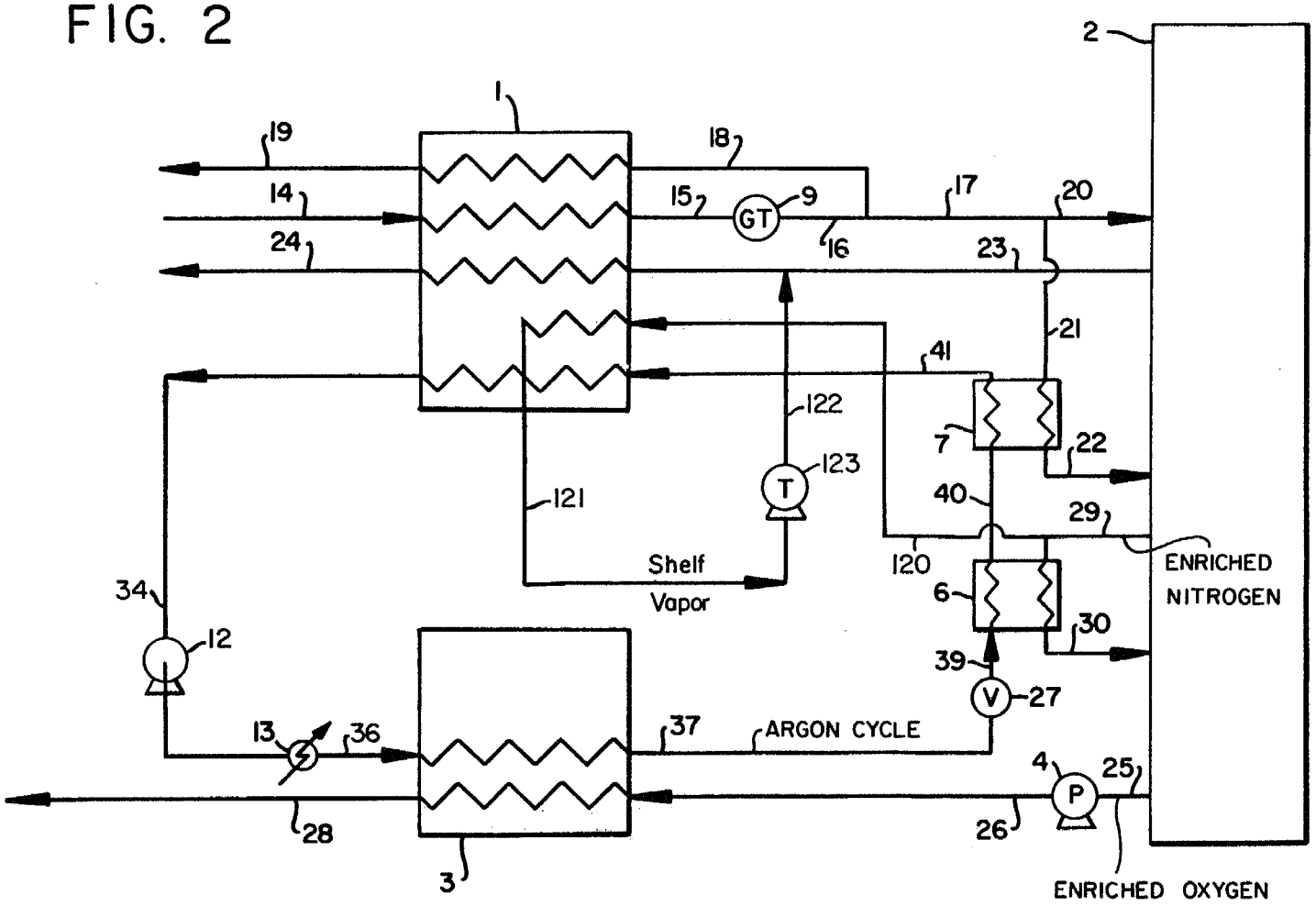
FIG. 2 is a schematic flow diagram representing another embodiment of the process of this invention wherein shelf vapor is employed to provide plant refrigeration and reversing heat exchanger cold end temperature control.

FIG. 2 illustrates another embodiment of the process of this invention. In this embodiment, shelf vapor is utilized to provide reversing heat exchanger temperature control and also plant refrigeration. This process arrangement utilizes nitrogen-rich vapor 120 available from the top of the high pressure column. The nitrogen vapor 120 is warmed in reversing heat exchanger unit 1 and withdrawn at an intermediate temperature level as stream 121. Such reversing heat exchanger unbalance stream 121 is used to control cold end temperature differences for the reversing heat exchanger and ensure contaminant removal by the nitrogen sweep gas. The intermediate temperature stream 121 is work expanded 123 to produce plant refrigeration and the low pressure nitrogen stream 122 can be added to the waste nitrogen 23 at the cold end of the reversing heat exchanger unit. Alternately, the low pressure stream 122 can be heated in a separate pass in reversing heat exchanger unit and recovered as low pressure nitrogen product.

Figure 3:
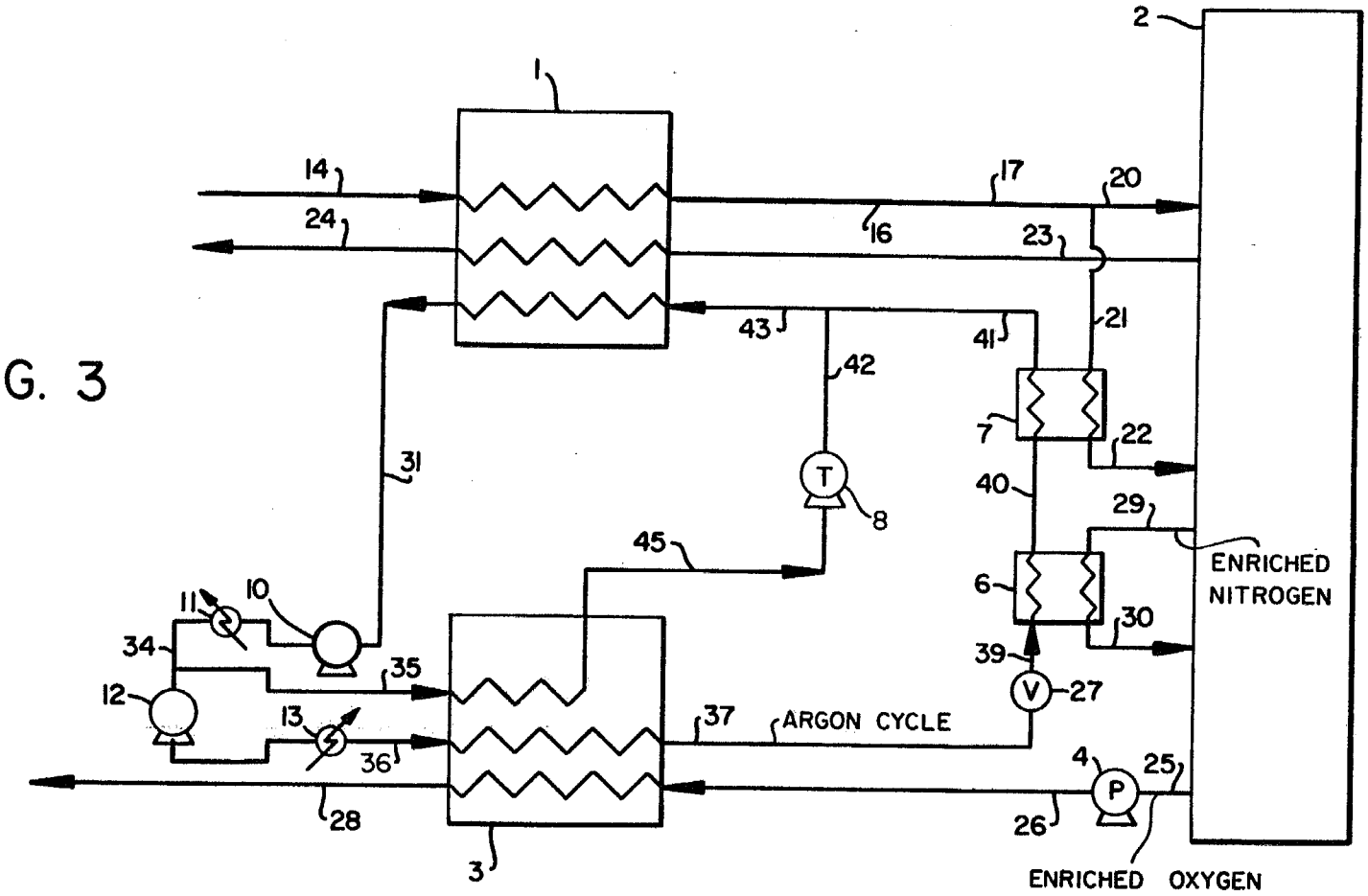
FIG. 3 is a schematic flow diagram representing another embodiment of the process of this invention wherein the argon containing fluid is additionally employed to provide plant refrigeration. In this embodiment, reversing heat exchangers are not employed.

FIG. 3 illustrates another embodiment of the process of this invention. In this embodiment, the recirculating heat pump fluid is also employed to provide plant refrigeration in addition to its use to vaporize the pumped liquid oxygen. The numbered streams and equipment in FIG. 3 correspond to the like numbered streams and equipment of FIG. 1 except for the plant refrigeration loop which will be described below. By plant refrigeration, it is meant that refrigeration which is required to make up for system heat inputs in order to maintain plant operation. The system heat inputs can include heat inleakage from the ambient temperature surroundings to the cold equipment, heat inleakage associated with necessary temperature differences for heat exchange between the process streams, heat inleakage associated with loss of some feed air water vapor as liquid during reversing heat exchanger operation, and heat inleakage associated with production of liquid products. Additionally, equipment inefficiencies can introduce heat input, such as those associated with the liquid pump. As shown in FIG. 3, the plant refrigeration loop involves the compression of recirculating fluid 31 in unit 10 and cooling in unit 11 to result in an intermediate pressure recirculating fluid stream 34. One portion of this recirculating stream is removed as stream 35 which is introduced to heat exchanger 3 where it is partly cooled. The partly cooled stream 45 is then work expanded in unit 8 to produce a low pressure, low temperature gas 42 which is the supply of plant refrigeration. This stream 42 is combined with that portion of the recirculating fluid 41 associated with the direct heat pumping duty and the combined fluid stream 43 is introduced to reversing heat exchanger unit 1. Herein stream 43, which is low pressure and associated with the recirculating heat pump circuit has the function of replacing low pressure oxygen product that would normally be heated in a reversing heat exchanger unit. Such a process arrangement has the advantage of maintaining a relatively low pressure stream in a reversing heat exchanger unit whereas the high pressure streams are separately maintained in heat pump exchanger 3. Within reversing heat exchanger unit 1 stream 43 is warmed and exits as stream 31.

Figure 4:
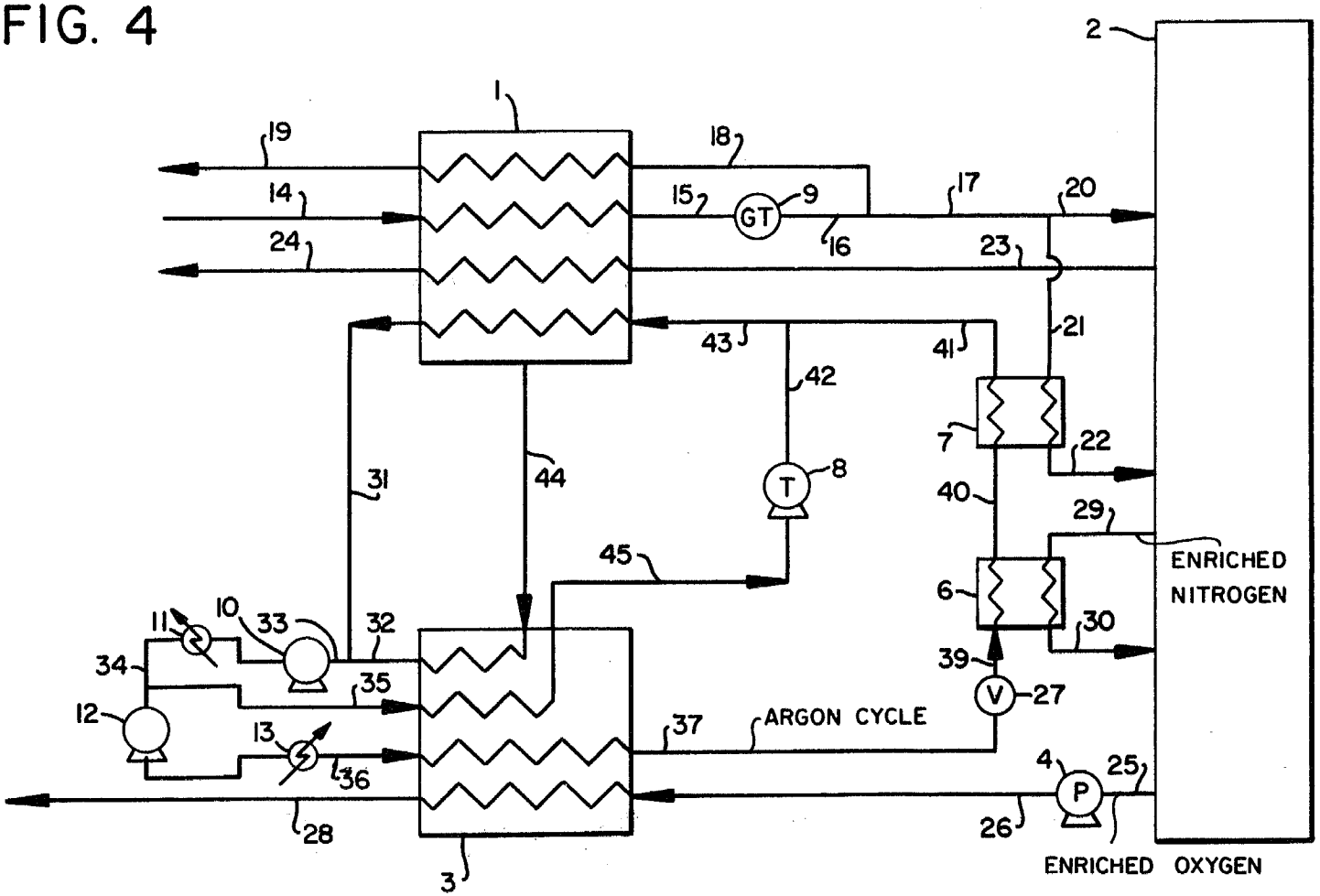
FIG. 4 is a schematic flow diagram representing the preferred embodiment of the process of this invention wherein the argon containing fluid provides both plant refrigeration and reversing heat exchanger cold end temperature control in addition to vaporizing the pumped liquid oxygen and condensing the nitrogen vapor.

FIG. 4 illustrates yet another embodiment of the process of this invention. In this embodiment, the recirculating heat pump fluid is also employed to provide cold end temperature control to the reversing heat exchanger in addition to providing plant refrigeration and vaporizing the pumped liquid oxygen. This embodiment, illustrated by FIG. 4, is the preferred embodiment of the process of this invention. The numbered streams and equipment in FIG. 4 correspond to the like numbered streams and equipment of FIG. 3 except for the reversing heat exchanger temperature control loop which will be described below. By reversing heat exchanger temperature control, it is meant that the temperature differences between the cooling air and warming nitrogen are regulated so as to ensure that the contaminants deposited from the high pressure air stream are removed by the low pressure nitrogen. Such temperature control will ensure that the reversing heat exchanger unit will be self-cleaning. Cold end temperature control means regulation of temperature differences with the reversing heat exchanger unit to ensure carbon dioxide contaminant removal. As shown in FIG. 4, the reversing heat exchanger temperature control loop involves the separation in reversing heat exchanger 1 of a portion of stream 43. This portion 44 is withdrawn from the reversing heat exchanger unit and the heating of that portion is completed in heat exchanger unit 3. The remaining portion 31 is warmed in heat exchanger unit 1 and the two portions 31 and 32 are then combined as 33. Thus, it can be seen that the control of fraction 44 and 31 is advantageous in that such control allows control of both the warm end and cold end temperature as required for proper contaminant removal. By increasing fraction 44, the cold end temperature can be decreased as desired in order to assure self-cleaning at the cold end of reversing heat exchanger unit 1. On the other hand, by maintaining fraction 31, the warm end temperature can be controlled. As fraction 31 is increased, the warm end temperature difference can be decreased as desired and thereby maintain relatively low heat input to the plant.

It should be noted that although the warm level heat transfer for recirculating fluid associated with the plant refrigeration (stream 45) and reversing heat exchanger cold end unbalance (stream 44) are illustrated as part of the oxygen warming heat exchanger unit 3, this is not a necessary requirement. For example, it may be advantageous to maintain oxygen warming unit 3 as a two-stream unit only from a pressure level and structural standpoint. This can be easily accomplished by heat exchanging streams 45 and 44 in a separate warm temperature level heat exchanger unit.

As is evident from the process arrangement, the recirculating fluid circuit is essentially closed and independent from the plant. However, it is understood small make-up streams can be added to the circuit to overcome system losses. The fluid circuit preferably incorporates essentially three functions: (1) the heat pumping as needed for the vaporization of pressurized product oxygen liquid, (2) the fluid circuit as needed with work expansion of fluid for plant refrigeration, and (3) the fluid circuit as needed for both warm end and cold end temperature control associated with the reversing heat exchanger. This process arrangement advantageously is able to combine all three of these functions in essentially a common circuit with readily controlled fluid flows directed towards each particular function. Such arrangement results in considerable process flexibility for the system from the standpoint of easy control, flexible operation, and additionally enhances column separation associated with section 2. Since functions associated with plant refrigeration and heat exchanger temperature control are not at all dependent on the column section as would otherwise be the case if for example, one were utilizing turbine air fractions or shelf vapor fractions for such purposes. Additionally, as noted previously, it can be seen that the preferred system is advantageous from the standpoint of segregating high pressure and low pressure heat exchange and thereby enhancing equipment specification and performance.

As previously indicated, fluid employed as the recirculating heat pump fluid is an argon containing mixture. The fluid is comprised of from 50 to 100 mole percent argon and from 0 to 50 mole percent oxygen; preferably from 70 to 90 mole percent argon and from 10 to 30 mole percent oxygen; most preferably the argon based fluid is comprised of about 80 mole percent argon and about 20 mole percent oxygen. However, it is understood that the argon containing fluid may contain minor amounts of other compounds normally found in argon such as nitrogen.

The process of this invention produces oxygen gas at greater than atmospheric pressure, preferably at a pressure of from 300 to 12,000 psia, most preferably from about 737 to 6000 psia. The most preferred pressure range recites the critical pressure of oxygen as the lower limit, for purposes of additional safety.

Figure 6:
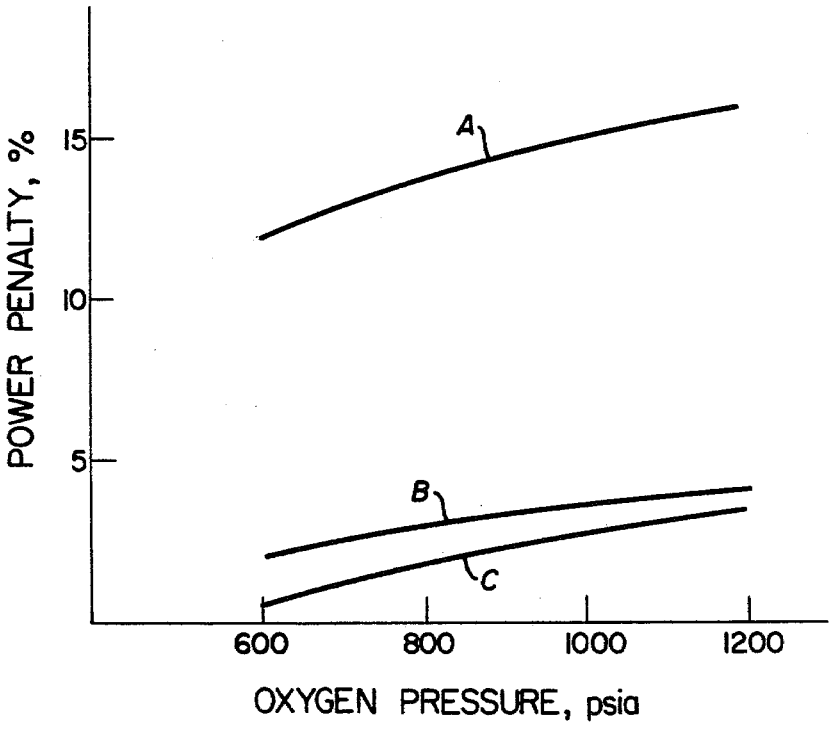
FIG. 6 is a graphic representation of the advantages of the preferred embodiment of the process of this invention.

In order to ascertain the performance advantages of the present invention, process calculations were performed to calculate the power penalty corresponding to both prior art and current invention liquid pumping processes compared to the usual gas phase compression process. By power penalty, it is meant the measure of energy requirements for the liquid pump process in excess of the requirements for the standard gas compression process relative to the requirements for the standard gas compression process. The results of that calculation are illustrated on attached FIG. 6. Curve A illustrated on that Figure shows the power penalty on a relative basis compared to gas compression for process systems utilizing prior art nitrogen fluid as a function of oxygen product pressure level. The process arrangement utilizes the nitrogen heat pump circuit to vaporize the liquid pumped oxygen but uses standard practice for both plant refrigeration and reversing heat exchanger temperature control. That is, the system utilizes the air stream for reversing heat exchanger cold end temperature control and turbine air expansion for plant refrigeration. Curves B and C illustrate the same relative power penalty for the current invention utilizing an argon and 80/20 argon-oxygen mixture, respectively.

It is apparent from the comparison that the preferred embodiment based on the argon mixture fluid has lower power penalties throughout the pressure range calculated. For example, considering 1000 psia oxygen supply, the prior art process has a 15% power penalty whereas the preferred argon fluid process has a 3.5% power penalty and the 80/20 argon-oxygen fluid has only a 2.7% power penalty. Over the range of 600 to 1200 psia oxygen supply, the preferred process has about 10% power advantage. It should be noted that all process comparisons were made for high purity (99.5% oxygen) product but that the prior art process (Curve A) was for oxygen only production whereas the preferred process (Curves B and C) were for multi-product production including high purity oxygen (99.5% oxygen) and equivalent amount of high purity nitrogen (10 ppm oxygen) and some crude argon (98% argon). The prior art process is not readily capable of multi-product production, since the high turbine air expansion associated with the added refrigeration required for the liquid pumping has an adverse impact on separation column performance.

The particular calculation utilized to illustrate the power comparisons were made for production of high purity 99.5% oxygen at a range of pressures as represented (that is 600 to 1200 psia). For illustration purposes, some of the pertinent process conditions associated with the FIG. 4 process arrangement are tabulated in attached Table I for the particular case of producing the high purity 99.5% oxygen at a supply pressure of 1000 psia. In addition, this tabulation includes minor low pressure liquid oxygen production as shown in FIG. 5, stream 87, and low pressure liquid nitrogen as shown in FIG. 5, stream 92. These conditions illustrate that the pressure conditions in the column and reversing heat exchanger are essentially normal whereas the high pressure fluid streams are retained in the heat pump heat exchanger 3. Note that the pressure levels of the refrigeration loop are not the same as the pressure required for vaporizing the product liquid. This arrangement retains flexibility for the process arrangement.

TABLE I

PROCESS CONDITIONS FOR LIQUID PUMPING OXYGEN PROCESS

| Process Stream, No. | | Flow (m cfh) | Temperature (°K.) | Pressure (psia) | Composition (mole %) |
|---|---|---|---|---|---|
| Feed Air, | 14 | 2154 | 300 | 100 | 21% $O_2$ |
| | 15 | 2154 | 102.9 | ~100 | 21% $O_2$ |
| Instrument Air, | 19 | 10 | 297 | ~100 | 21% $O_2$ |
| Waste Nitrogen, | 24 | 1671 | 297 | 15 | <1% $O_2$ |
| Product Oxygen, | 25 | 446 | 95 | 23 | 99.5% $O_2$ |
| | 26 | 446 | 102 | 1006 | 99.5% $O_2$ |
| | 28 | 446 | 296 | 1000 | 99.5% $O_2$ |
| Product Oxygen Liquid, | 87 | 4 | 95 | 23 | 99.5% $O_2$ |
| Product Nitrogen Liquid, | 92 | 4 | ~80 | 36 | <10 ppm $O_2$ |
| Argon Mixture, | 36 | 493 | 300 | ~1130 | 80/20, Ar/$O_2$ % |
| | 37 | 493 | 103.2 | 1130 | 80/20, Ar/$O_2$ % |
| | 39 | 493 | 95.7 | 32 | 80/20, Ar/$O_2$ % |
| | 35 | 417 | 300 | 320 | 80/20, Ar/$O_2$ % |
| | 45 | 417 | 194 | ~320 | 80/20, Ar/$O_2$ % |
| | 42 | 417 | 100 | ~32 | 80/20, Ar/$O_2$ % |
| | 44 | 336 | 190 | ~32 | 80/20, Ar/$O_2$ % |
| | 31 | 574 | 297 | ~32 | 80/20, Ar/$O_2$ % |

What is claimed is:

1. A process for the production of oxygen gas at greater than atmospheric pressure comprising the steps of:

(a) introducing cleaned, cooled air into a distillation column;

(b) separating said air into oxygen-rich and nitrogen-rich fractions in said column;

(c) removing from said column at least a portion of said oxygen-rich fraction as liquid;

(d) pumping said liquid oxygen-rich portion to the desired pressure of at least about 600 psia;

(e) vaporizing said liquid oxygen-rich portion to oxygen gas at said desired pressure by indirect heat exchange with an argon containing fluid, recirculating in an essentially closed loop, said fluid comprising from 50 to 100 mole percent argon and from 0 to 50 mole percent oxygen;

(f) recovering said oxygen gas at said desired pressure;

(g) removing from said column at least a portion of a nitrogen-rich fraction as gas;

(h) condensing said gaseous nitrogen-rich portion by indirect heat exchange with said recirculating argon containing fluid; and (i) returning said condensed nitrogen-rich portion back to said column, wherein said condensed nitrogen-rich portion is returned to said column in an amount sufficient to make up the nitrogen liquid reflux associated with said removed liquid oxygen-rich portion.

2. A process as claimed in claim 1 wherein said desired pressure is from about 737 to 6000 psia.

3. A process as claimed in claim 1 wherein said argon based fluid is comprised of from 70 to 90% mole percent argon and from 10 to 30 mole percent oxygen.

4. A process as claimed in claim 1 wherein said argon based fluid is comprised of about 80 mole percent argon and about 20 mole percent oxygen.

5. A process as claimed in claim 1 wherein a portion of said recirculating argon based fluid is withdrawn as gas from the main stream, work-expanded, and reunited with said main stream after said main stream has effected heat transfer contact with said liquid oxygen-rich portion and said nitrogen-rich portion, whereby said work-expanded gaseous argon based fluid portion provides plant refrigeration.

6. A process as claimed in claim 5 wherein a portion of said recirculating argon based fluid is withdrawn from the main stream before complete traversal of a reversing heat exchanger, and is reunited with said main stream after said main stream has completely traversed said reversing heat exchanger, whereby reversing heat exchanger cold-end temperature control is provided.

7. A process as claimed in claim 1 wherein in step (c) of claim 1, said portion comprises at least 50% of the available product oxygen.

* * * * *